US010188883B2

(12) United States Patent
Pich

(10) Patent No.: US 10,188,883 B2
(45) Date of Patent: Jan. 29, 2019

(54) PROCESS TO STOP AND/OR PREVENT THE SPREADING OF PEAT FIRES

(75) Inventor: René Pich, Saint Etienne (FR)

(73) Assignee: S.P.C.M. SA, Andrezieux Boutheon (FR)

( * ) Notice: Subject to any disclaimer, the term of this patent is extended or adjusted under 35 U.S.C. 154(b) by 900 days.

(21) Appl. No.: 14/369,131

(22) PCT Filed: Jan. 9, 2012

(86) PCT No.: PCT/FR2012/050048

§ 371 (c)(1),
(2), (4) Date: Dec. 19, 2014

(87) PCT Pub. No.: WO2012/063008

PCT Pub. Date: May 18, 2012

(65) Prior Publication Data

US 2015/0165248 A1 Jun. 18, 2015

(51) Int. Cl.

| | |
|---|---|
| ***E02F 5/02*** | (2006.01) |
| ***A62C 3/02*** | (2006.01) |
| ***E02F 5/14*** | (2006.01) |

(52) U.S. Cl.

CPC ..... *A62C 3/0278* (2013.01); *E02F 5/02* (2013.01); *E02F 5/14* (2013.01)

(58) Field of Classification Search

CPC . A62C 3/0278; E02F 5/02; E02F 5/14; B09C 1/08; B09C 1/002; B09C 1/00; E02D 3/12; C09K 17/12

USPC ..... 169/43–45, 48; 405/128.1, 128.7, 405/128.75, 263

See application file for complete search history.

(56) References Cited

U.S. PATENT DOCUMENTS

| | | | | |
|---|---|---|---|---|
| 2,864,181 A | | 12/1958 | Simmons | |
| 3,047,184 A | * | 7/1962 | Van Bergen | E04H 7/065 220/560.12 |
| 3,162,231 A | * | 12/1964 | Emerson | B21D 31/046 29/6.1 |
| 3,349,953 A | * | 10/1967 | Conaway | B60K 15/077 220/734 |
| 3,356,256 A | * | 12/1967 | Szego | A62C 3/06 220/88.1 |
| 3,475,333 A | * | 10/1969 | Meldrum | A62C 3/06 169/66 |
| 3,687,329 A | * | 8/1972 | Baum | A62C 3/06 169/66 |
| 3,822,807 A | * | 7/1974 | MacDonald | B65D 90/40 220/560.01 |
| 4,013,190 A | * | 3/1977 | Wiggins | A62C 4/00 220/501 |

(Continued)

FOREIGN PATENT DOCUMENTS

WO 2007/104720 A1 9/2007

OTHER PUBLICATIONS

International Search Report and Written Opinion dated Aug. 9, 2013, for International Application No. PCT/FR2012/050048, 10 pages.

*Primary Examiner* — Chee-Chong Lee
(74) *Attorney, Agent, or Firm* — Heslin Rothenberg Farley & Mesiti P.C.

(57) ABSTRACT

Process to stop and/or prevent the spreading of peat fires consisting of:

digging a trench in the periphery of the area of outbreak of fire or potential fire, filling the trench at least partially with a superabsorbent (co)polymer (SAP).

20 Claims, 4 Drawing Sheets

(56) References Cited

U.S. PATENT DOCUMENTS

| | | | | | |
|---|---|---|---|---|---|
| 4,149,649 | A * | 4/1979 | Szego | B65D 90/40 | 169/66 |
| 4,224,989 | A * | 9/1980 | Blount | E21B 21/08 | 166/271 |
| 4,249,669 | A * | 2/1981 | Szego | A62C 3/06 | 220/216 |
| 4,251,699 | A * | 2/1981 | Wiltgen, Jr. | H01H 33/22 | 169/46 |
| 4,265,317 | A * | 5/1981 | Knecht | E04B 1/941 | 169/50 |
| 4,323,118 | A * | 4/1982 | Bergmann | E21B 33/02 | 166/356 |
| 4,587,308 | A | 5/1986 | Makita et al. | | |
| 5,989,446 | A * | 11/1999 | Hicks | A62D 1/0042 | 106/18.11 |
| 7,717,187 | B1 * | 5/2010 | Miller | A62C 2/10 | 169/45 |
| 2006/0076531 | A1 | 4/2006 | Hagguist et al. | | |
| 2009/0151961 | A1 | 6/2009 | Voorhees | | |

* cited by examiner

PROCESS TO STOP AND/OR PREVENT THE SPREADING OF PEAT FIRES

Underground peat fires are very common in certain countries such as Russia, Indonesia, Finland, Canada, Sweden and Norway.

In fact, very large surface areas are covered with peat. For example: 1.1 million $km^2$ in Canada, 750,000 $km^2$ in the Soviet Union, 263,000 $km^2$ in Indonesia.

These peat fires are started in varies ways:

forest fires which spread into the soil, lightning which sets vegetation on fire, auto-ignition of stacks of peat when used for various applications (fuel, coke, farming, etc), internal auto-ignition during very dry weather, accidental or deliberates fires, especially fires on agricultural land.

These peat fires are common from late summer to the beginning of autumn, especially during very dry years (e.g. 1972 in Russia). The surface peat dries and rises in temperature due to fermentation and auto-oxidation.

Peat in soil can vary greatly in thickness with the following layers:

top mineral soil (0 to 1 m)

humus (0.2 to 0.3 m)

poorly decomposed white peat (0.8 to 1.50 m)

well decomposed black peat (0.8 to 4 m)

sludge and sand impermeable to water

In the majority of cases, the thickness ranges from 1 to 5 meters.

Given the surface areas, a lot of towns and villages or detached houses are built in areas containing peat with the foundations of buildings going down to the mineral soil by evacuating the peat layer.

Sometimes buildings are built on piles without evacuating the peat which is extremely dangerous.

Finally, the green belt areas in towns and around towns are not accounted for thereby allowing for peat fires to spread very close to housing areas.

Peat fires are very different to fight. Most often, trenches are dug out with excavators and the fire is put out in these trenches with fire hoses. However, often these trenches are not deep enough and the fire goes beyond them.

In fact, it is the deep layers containing a lot of bitumen and protected from water due to being permeable that cause the fire to spread.

Water pressurised at 2 to 6 bars is injected into shallow fires using rods of 1 to 1.50 m by moving these injection tubes. This only works on small-scale and shallow fires.

In other cases, attempts are made to bring in maximum quantities of water, treated with a surfactant (petroleum sulfonate) and fire retardants (phosphates).

In all cases, it is difficult to spread the water into the hydrophobic subsoil to put the fire out completely. In other cases, there are zones of fracture where the water goes through the layer without wetting it.

As recently as 2010, huge peat fires took place in Russia without much success in fighting them.

The problem raised is therefore to develop a process to stop peat fires from spreading either as a curative measure in the event of an outbreak of fire or as a preventive measure to protect towns or houses. This operation must be quick and as inexpensive as possible or implemented on a permanent basis.

To do this, the Applicant has developed a process to overcome all these problems by implementing superabsorbent co(polymers) or SAPs with a high swelling capacity in water. By definition, these polymers are crosslinked. They are copolymers, terpolymers, etc or a blend of these and the main characteristic of which is a high swelling capacity in aqueous media.

Superabsorbent polymers are polymers well known in the fine chemical industry. They usually come in powder form. Their structure based on a three dimensional network similar to a multitude of small cavities each capable of being deformed and absorbing water gives them the property of absorbing very large quantities of water and therefore swelling. Such polymers are for example described in the patent FR 2 559 158 which describes acrylic or methacrylic acid crosslinked polymers, crosslinked graft polymers of the polysaccharide/acrylic or methacrylic acid type, crosslinked terpolymers of the acrylic or methacrylic acid/acrylamide/sulfonated acrylamide type and their alkaline-earth or alkali metal salts.

As already stated, the main characteristic of these polymers is a high swelling capacity in aqueous media. They can absorb and keep large quantities of water up to 100 times or more of their mass in liquid. They are notably used in agriculture to retain water in soils, in baby hygiene products to contain urine and similar applications.

It appears, for example that crosslinked polyacrylamide SAPs adsorbing 100 to 250 times their volume in water according to the salinity, are extremely efficient thermal barriers.

In other terms, the invention relates to a process to stop and/or prevent the spreading of peat fires consisting of:

digging a trench in the periphery of the area of outbreak of fire or potential fire, filling the trench at least partially with at least one superabsorbent (co)polymer (SAP).

In an initial embodiment, the SAPs are partially or totally swollen, i.e. they are previously mixed with water then partially or totally swollen with the said water before filling the trench.

The SAP is partially or totally swollen. A totally swollen SAP is characterize by the fact that all the small cavities of the three dimensional network are filled with water to saturation, i.e. to a level such that by adding additional water, the SAP no longer absorbs additional water.

The invention therefore relates to using a superabsorbent polymer as a thermal barrier by filling a trench with partially or totally swollen SAPs. This partially or totally swollen SAP is referred to under the name of "solid water" given that it can contain up to 99% water.

The trenches can be dug at high speed using a trencher especially in a loose material at a speed of 5 km/hour depending on the width and the depth.

These trenchers are of several types:

wheel trencher which allows for maximum depths of 1.20 m/1.50 m with a very narrow passage: 10 to 20 cm.

Chain trenchers capable of going to 8 meters deep on loose ground. The trench width depends on the rigidity of the arm and is between a minimum of 20 to 40 cm. Some trenchers can go up to 1 meter and over.

In practice, the trench width is between 20 and 40 cm. This width must be a minimum in order to reduce the consumption of superabsorbent polymer. The width may be determined by specific tests.

Trenchers are of very different builds and power ratings from 50 to 1,500 HP according to the type of soil (loam, stony earth, limestone, rock, etc), the depth and the width of the trench. They are often used in agriculture to bury irrigation pipes. These trenches may be filled with water. Unfortunately in this case, the water percolates and disappears and the walls collapse.

In the case of peat, a thickness of 20-40 cm of partially or totally swollen superabsorbent polymer suffices to stop the fire from spreading.

Some trenchers are provided with conveyor belts so as to remove the excavated materials. In the case of peat, it is important to remove these products and store them in damp conditions so as to avoid auto-ignition.

In a second embodiment, the SAP is not previously swollen on filling the trench but is deposited independently from the water. It is then flooded with water which has been added either before depositing the SAP or after, which leads to it totally or partially swelling directly in the trench. Thus, for shallow trenches (1 m) and walls of very low porosity, it is possible to deposit the polymer in the bottom of the trench and bury it in water. In such a case, higher grain sizes are preferred (less than 4 mm) which enable better distribution of the water but with a high swelling time.

Advantageously, the polymers are chosen from the group including:

- crosslinked copolymers obtained by polymerization of acrylamide and partially or totally salified acrylic acid, preferably in the form of a sodium salt,
- crosslinked polyacrylic acids, partially or totally salified, preferably in the form of a sodium salt.

In a preferred embodiment, the polymers are crosslinked copolymers of acrylamide and partially or totally salified acrylic acid and contain between 40 and 90 mol % of acrylamide and between 10 and 60 mol % of partially or totally salified acrylic acid.

In a specific embodiment, the SAP is a terpolymer derived from the polymerization of acrylamide and/or partially or totally salified acrylic acid and/or partially or totally salified acrylamide tertiary butyl sulfonic acid (ATBS) and/or N-vinylpyrrolidone (NVP). Advantageously the ATBS and/or NVP content is approximately 10 mol %.

Other hydrophilic monomers, but also hydrophobic monomers, could be used to produce the polymers.

The copolymers are crosslinked with 100 to 6,000 parts per million (ppm) of at least one crosslinking agent chosen from the group including the acrylic (methylene bis acrylamide), allyl (tetra-allylammonium chloride), vinyl (divinyl benzene), diepoxy, metallic salts compounds, etc.

These polymers are stable for several years in soil.

Stability can be improved by performing double crosslinking with an acrylic crosslinking agent, preferably at a rate of 100 to 1,000 ppm and an allylic crosslinking agent, preferably at a rate of 1,000 to 5,000 ppm, for instance MBA (methylenebisacrylamide) and tetra-allylammonium chloride, which extends the stability of a SAP to over 5 years. Beyond this, the swelling is reduced as is the volume taken up by the polymer in the trench.

For very acid environments, it is also possible to mix the superabsorbent polymer before being swollen with 10 to 20% calcium carbonate and sodium carbonate. Calcium carbonate is preferred as it does not reduce the swelling of the SAP.

Compounds improving the extinguishing capacity of the water can also be included in the polymer. This can be phosphates for instance, ammonium, bicarbonate for instance potassium, urea, etc. However the salts dissolved in the water reduce the swelling. Urea is thus preferred.

With regard to the physical management of these trenches, the building of platforms is required for vehicles to pass distributing the loads either side.

It is also possible in the event of a reduction in volume, to reinject the pre-swollen superabsorbent polymer for instance using a tanker truck with a Moineau type displacement pump.

More specifically, the superabsorbent (co)polymer is swollen in a processing center and transported by tanker truck to the site of treatment.

A lot of modifications of this peat fire treatment principle are possible by the person skilled in the art in order to adapt the equipment to the local circumstances.

It is in particular possible to pre-position such trenches around towns, industrial facilities, energy generators or detached houses.

It is also possible to block fires by providing trenches at a distance calculated with respect to the progress of these fires.

It is possible to treat large areas by separating them by such trenches.

In the case of shallow to medium depth peat, it is possible to accelerate the trenches up to 20 km/hour, fill the trenches with water per area and insert the powder superabsorbent polymer in several phases for even swelling. Local tests are to be performed in order to define the optimum conditions and in particular the resistance of the walls.

For large surface areas, it is possible to develop specific equipment highly suited to this type of process where loose ground is involved where the power consumption is low.

Obviously, in all cases, it is of prime importance to clear away fallen trees or undergrowth over a width of several meters.

The invention also relates to a installation implementing the process described above and including:

- a means likely to dig a trench in the periphery of the area of outbreak of fire or potential fire,
- a means of storage of the superabsorbent (co)polymer,
- a means of injecting the superabsorbent (co)polymer into the trench.

In a preferred embodiment, the SAPs are partially or totally swollen prior to filling the trench.

Under these conditions, the facility contains in addition:

- a means of dosing the superabsorbent (co)polymer,
- a means of dosing the water
- a means of mixing the water and the superabsorbent (co)polymer,
- a means of pumping the partially or totally swollen superabsorbent (co)polymer obtained,
- a means of injecting the partially or totally swollen superabsorbent (co)polymer into the trench.

Advantageously, the means for mixing the water and the polymer is in the form of two successive tanks allowing for continuous and even swelling of the superabsorbent polymer.

The invention and the resulting advantages will be made well apparent in the following example, backed up by the appended figure.

DESCRIPTION OF THE EXAMPLES

A wheel trencher is an example allowing for trenches of a maximum depth of 1.20 m/1.50 m with a very narrow passage of approximately 10 to 20 cm.

Figure 1:
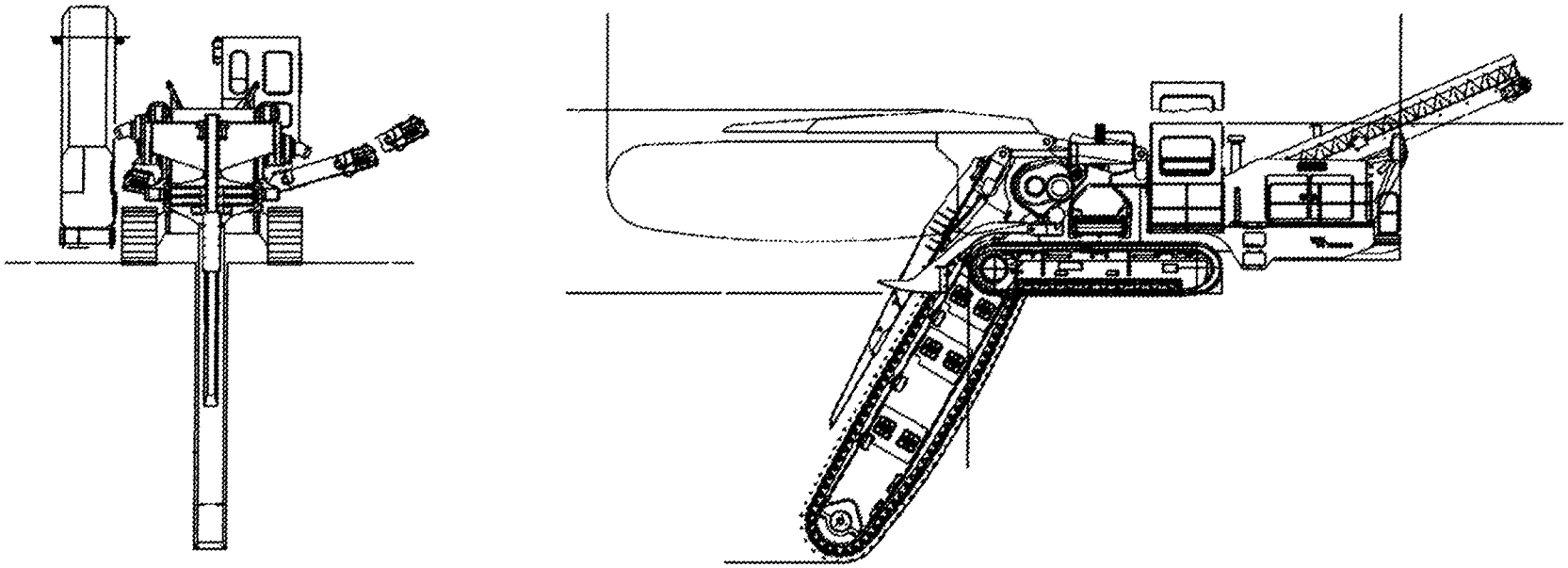
FIG. 1 is a representation of a chain trencher digging a trench (front and side views).
Figure 2:
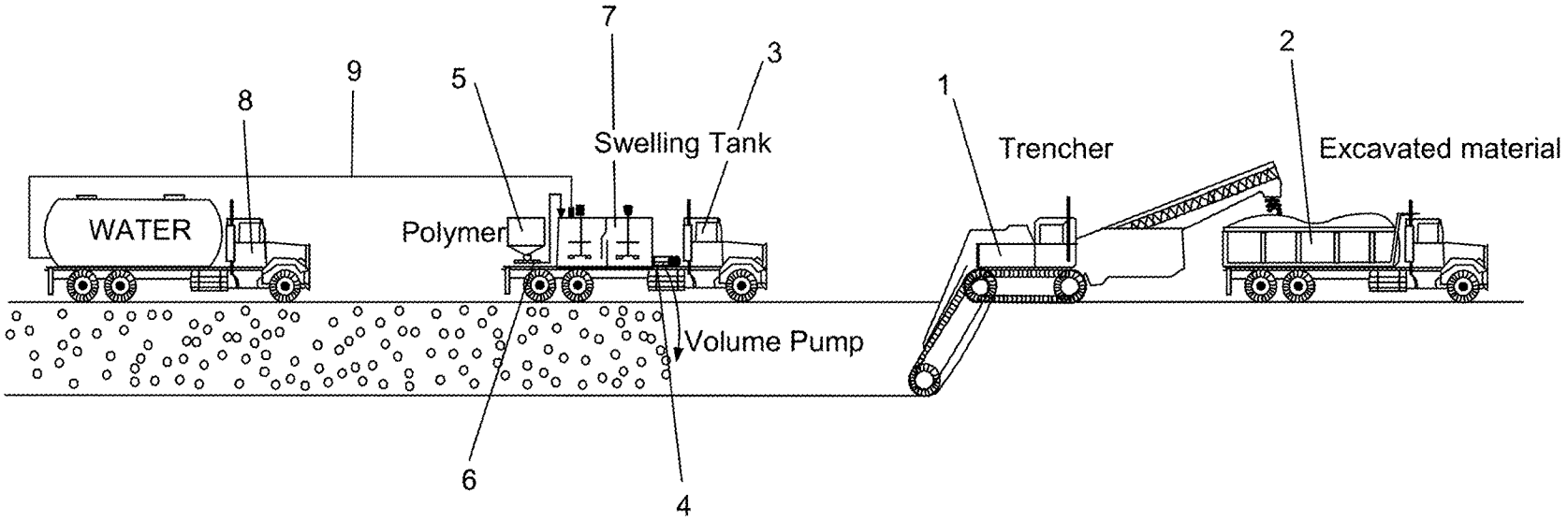
FIG. 2 is a representation of the facility of the invention according to a preferred embodiment.
Figure 3:
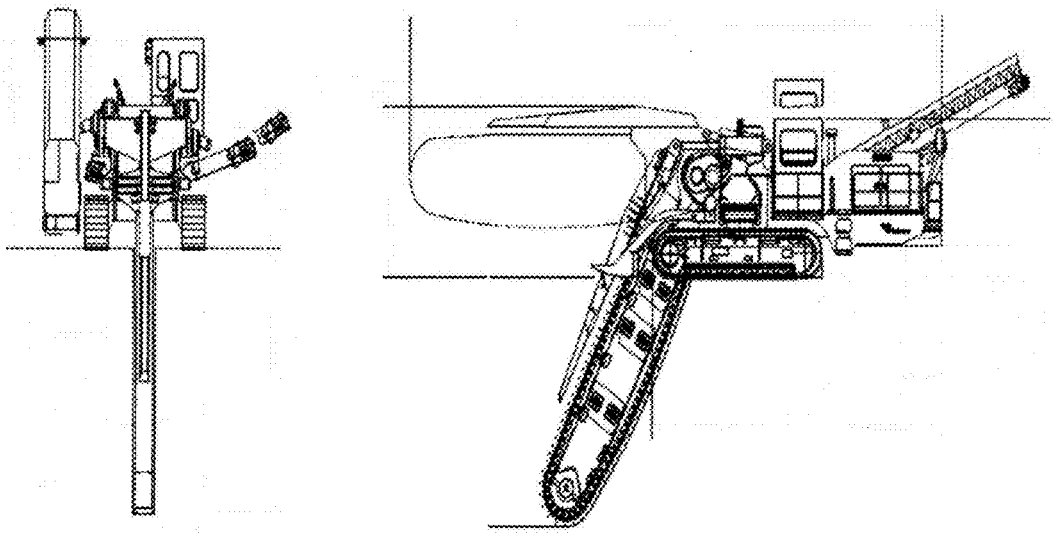
Figure 4:
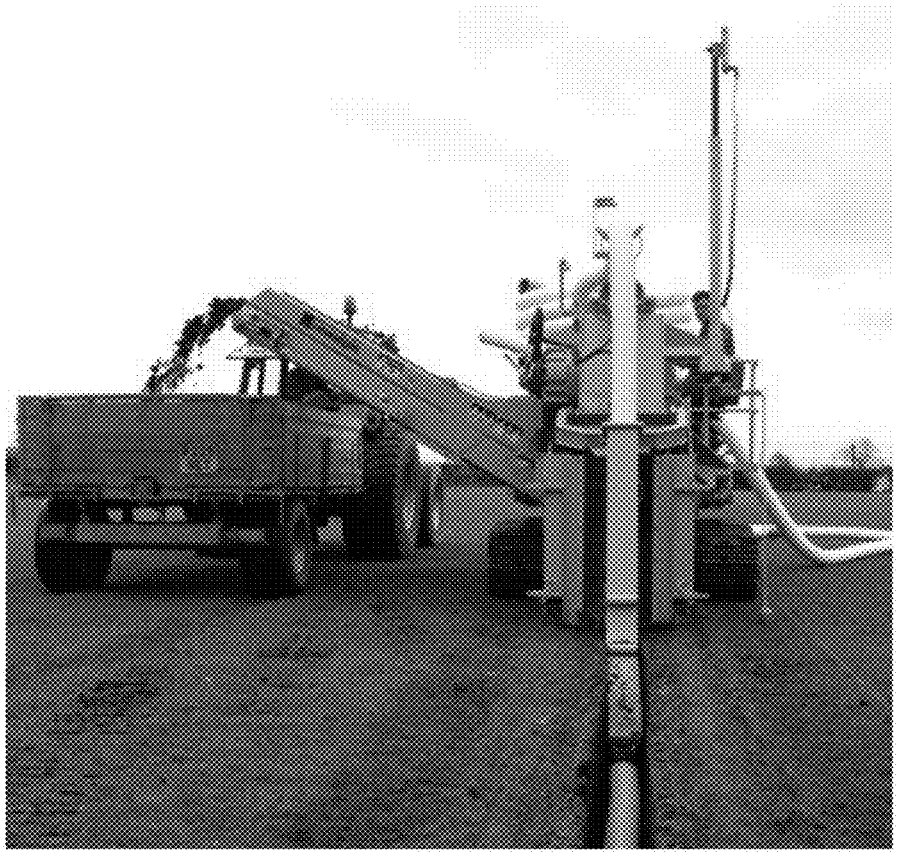
Figure 5:
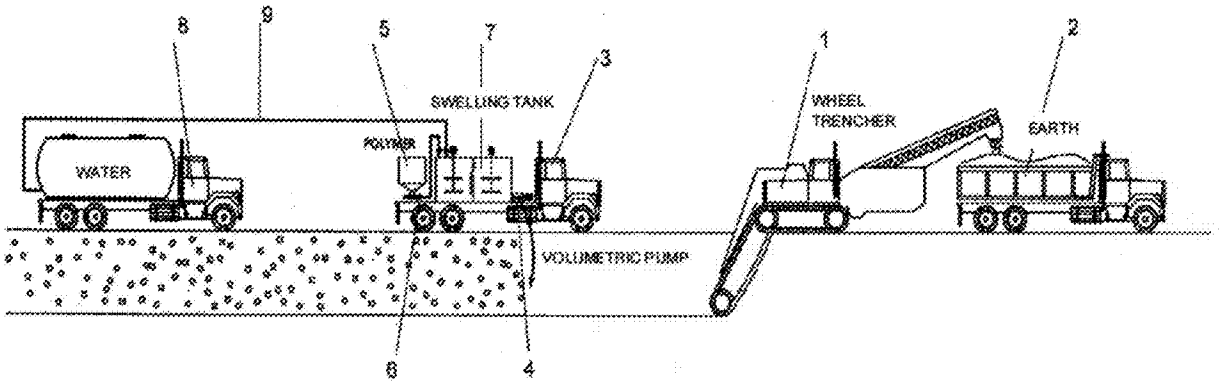

FIG. 1 represents chain trenchers allowing for trenches of up to 8 meters deep on loose ground. The trench width depends on the rigidity of the arm and is between a minimum of 20 to 40 cm. Some trenchers can go up to 1 meter and over. FIG. 2 is a representation of a facility implementing the process of the invention according to a specific embodiment.

FIG. 2 shows that a trencher (1) forms the trench and evacuates the earth into a truck (2). At the rear, a truck (3) injects the swollen SAPs into the trench using a Moineau type displacement pump (4). This truck contains a hopper (5) containing the polymer, a screw dosing device (6), two swelling tanks with agitators (7) allowing for contact of the SAP with the water. At the rear of the second truck (3), a third truck (8) supplies the water via a valve and a pipeline (9) connecting the truck (8) to the swelling tanks (7).

In certain cases, a set of trailers towed by a powerful tractor and including a swelling trailer, a polymer trailer and a water trailer which is filled by a substantial number of trucks, can be used. The construction of this equipment obviously depends on the service required.

The quantities of (co)polymer to be inserted per trench of a width of 20 cm and 4 meters deep are 800 liters per meter usually including (medium hard water) 782 liters of water and 8 kg of polymer. The swelling time depends on the grain size of the polymer. It is approximately 1 hour for a polymer of a grain size of less than 1 mm. Sometimes bigger grain sizes of less than 4 mm are preferred with a longer swelling time (approximately 3 hours). It is possible to inject copolymers that are not fully swollen and which finish swelling in the trench with an excess of water.

With a truck of 20 $m^3$ of water, it is possible to treat a trench of 20 to 40 meters depending on the depth and thickness. This therefore requires a substantial number of water trucks.

A 5-tonne container of polymer would allow for a length of 600 meters to be treated and a 20-tonne truck, 2,500 meters.

The person skilled in the art could adapt this basic facility to the local characteristics.

The invention claimed is:

1. A process to stop and/or prevent the spreading of peat fire, the process comprising:

digging a trench into soil of a periphery of an area of outbreak of peat fire or potential peat fire, wherein at least some peat is in the soil; and filling said trench at least partially with at least one superabsorbent (co)polymer (SAP), wherein the at least one superabsorbent (co)polymer (SAP) is an acrylamide and partially or totally salified acrylic acid crosslinked copolymer and contains between 40 and 90 mole percentage (mol %) of acrylamide and between 10 and 60 mol % of partially or totally salified acrylic acid.

2. Process according to claim 1 wherein the at least one superabsorbent (co)polymer (SAP) is partially or totally swollen with water before filling the trench.

3. Process according to claim 2 wherein the water is mixed with one or more compounds capable of improving the extinguishing ability of the said water, and wherein the one or more compounds are phosphate, bicarbonate, or urea.

4. Process according to claim 1 wherein the at least one superabsorbent (co)polymer (SAP) is deposited directly in the trench then totally or partially swollen with prior or subsequent input of water.

5. Process according to claim 4 wherein the water is mixed with one or more compounds capable of improving the extinguishing ability of the said water, wherein the one or more compounds are phosphate, bicarbonate or urea.

6. Process according to claim 1 wherein the trench is 20 to 40 centimeters wide.

7. Process according to claim 1 wherein the trench is up to 8 meters in depth.

8. Process according to claim 1 wherein the partially or totally salified acrylic acid is in the form of a sodium salt.

9. Process according to claim 1 wherein the at least one superabsorbent (co)polymer (SAP) undergoes double crosslinking by an acrylic crosslinking agent at a rate of 100 to 1,000 parts per million (ppm) and an allylic crosslinking agent at a rate of 1,000 to 5000 ppm.

10. Process according to claim 9 wherein the acrylic crosslinking agent is MBA (methylenebisacrylamide) and wherein the allylic crosslinking agent is tetra-allylammonium chloride.

11. Process according to claim 1 wherein the at least one superabsorbent (co)polymer (SAP) is mixed with 10 to 20% calcium carbonate or sodium carbonate.

12. Process according to claim 1 wherein the at least one superabsorbent (co)polymer (SAP) is continuously partially or totally swollen in successive tanks and is injected into the trench.

13. Process according to claim 1 wherein the at least one superabsorbent (co)polymer (SAP) is swollen in a processing center and transported by tanker trucks to a treatment site where the process is performed.

14. A process to stop and/or prevent the spreading of peat fire, the process comprising:

digging a trench into soil of a periphery of an area of outbreak of peat fire or potential peat fire, wherein at least some of the peat is in the soil; and filling said trench at least partially with at least one superabsorbent (co)polymer (SAP), wherein the at least one superabsorbent (co)polymer (SAP) undergoes double crosslinking by an acrylic crosslinking agent at a rate of 100 to 1,000 parts per million (ppm) and an allylic crosslinking agent at a rate of 1,000 to 5000 ppm.

15. The process according to claim 14 wherein the acrylic crosslinking agent is MBA (methylenebisacrylamide) and wherein the allylic crosslinking agent is tetra-allylammonium chloride.

16. The process according to claim 14 wherein the at least one superabsorbent (co)polymer (SAP) is partially or totally swollen with water before filling the trench.

17. The process according to claim 14 wherein the at least one superabsorbent (co)polymer (SAP) is deposited directly in the trench then totally or partially swollen with prior or subsequent input of water.

18. The process according to claim 14 wherein the trench is 20 to 40 centimeters wide.

19. The process according to claim 14 wherein the trench is up to 8 meters in depth.

20. The process according to claim 14 wherein the at least one superabsorbent (co)polymer (SAP) is a crosslinked copolymer or a crosslinked polyacrylic acid, wherein:

the crosslinked copolymer is a copolymer of acrylamide and partially or totally salified acrylic acid, and the crosslinked polyacrylic acid is partially or totally salified.

* * * * *